US005364260A

United States Patent [19]

Moore

[11] Patent Number: 5,364,260

[45] Date of Patent: Nov. 15, 1994

[54] FUEL CONTROL SYSTEM, CONTROL MEANS THEREFOR AND METHODS OF MAKING THE SAME

[75] Inventor: Dwain F. Moore, Holland, Mich.

[73] Assignee: Robertshaw Controls Company, Richmond, Va.

[21] Appl. No.: 68,755

[22] Filed: May 28, 1993

[51] Int. Cl.[5] ..... F23N 5/20

[52] U.S. Cl. ..... 431/6; 431/27; 431/67

[58] Field of Search ..... 431/67, 27, 6

[56] References Cited

U.S. PATENT DOCUMENTS 4,615,282 10/1986 Brown ..... 431/67

4,925,386 5/1990 Donnelly et al. ..... 431/28

4,934,925 6/1990 Berlincourt ..... 431/67

*Primary Examiner*—Carroll B. Dority

*Attorney, Agent, or Firm*—Candor, Candor & Tassone

[57] ABSTRACT

A fuel control system, a control unit therefor and methods of making the same are provided, the system comprising a control unit that reduces the length of the warm-up time period of an igniter in subsequent successive burner cycles in which ignition is successful until the control device detects an increase in the length of the flame detecting time period in that particular successive burner cycle over the length of the flame detecting time period on a previous burner cycle at which time the control device then increases the length of the previously reduced warm-up time period a certain amount.

20 Claims, 1 Drawing Sheet

FUEL CONTROL SYSTEM, CONTROL MEANS THEREFOR AND METHODS OF MAKING THE SAME

BACKGROUND OF THE INVENTION

1. Field of the Invention

This invention relates to a new fuel control system for a burner means and to a new control means for such a system as well as to a new method of making such a control system and to a new method of making such a control means.

2. Prior Art Statement

It is known to provide a fuel control system comprising a burner means, valve means for controlling the flow of fuel to the burner means, an electrical resistance igniter means for being connected across a power source for igniting fuel at the burner means, flame detecting means for detecting flame at the burner means, and control means operatively interconnected to all of the other means for connecting the igniter means across the power source for a warm-up time period at the start of each burner cycle and then operating the valve means to supply fuel to the burner means for a valve trial time period that begins upon the lapse of the warm-up time period, the flame detecting means causing the control means to tend to continue to operate the valve means to supply the fuel to the burner means during that particular burner cycle if the flame detecting means detects flame at the burner means before the lapsing of the trial time period, the time period it takes to detect flame by the flame detecting means beginning from the start of the valve trial time period to when flame is detected in any burner cycle comprising a flame detecting time period for that particular burner cycle, the control means reducing the length of the warm-up time period in subsequent successive burner cycles in which ignition is successful until the control means detects a certain event in a particular successive burner cycle at which time the control means then increases the length of the previously reduced warm-up time period a certain amount, the certain event being an unsuccessful burner cycle in which ignition does not occur. For example, see the U.S. Pat. No. 4,925,386 to Donnelly et al.

SUMMARY OF THE INVENTION

It is one of the features of this invention to provide a new fuel control system wherein operation of the electrical resistance igniter means for igniting fuel that issues from a burner means during each burner cycle is operated with a warm-up time period that has been uniquely predetermined.

In particular, it has been found according to the teachings of this invention that the control means of such a fuel control system can reduce the length of the warm-up time period in subsequent successive burner cycles in which ignition is successful until the control means detects an increase in the length of the flame detecting time period in that particular successive burner cycle over the length of the flame detecting time period on a previous burner cycle at which time the control means then increases the length of the previously reduced warm-up time period a certain amount so that thereafter during subsequent successive burner cycles, the warm-up time period for supplying power to the electrical resistance igniter means is at a reduced rate from the normally specified warm-up time period for the igniter means so as to tend to extend the life of the igniter means.

For example, one embodiment of this invention comprises a fuel control system comprising a burner means, valve means for controlling the flow of fuel to the burner means, an electrical resistance igniter means for being connected across a power source for igniting fuel at the burner means, flame detecting means for detecting flame at the burner means, and control means operatively interconnected to all of the other means for connecting the igniter means across the power source for a warm-up time period at the start of each burner cycle and then operating the valve means to supply fuel to the burner means for a valve trial time period that begins upon the lapse of the warm-up time period, the flame detecting means causing the control means to tend to continue to operate the valve means to supply the fuel to the burner means during that particular burner cycle if the flame detecting means detects flame at the burner means before the lapsing of the valve trial time period, the time period it takes to detect flame by the flame detecting means beginning from the start of the valve trial time period to when flame is detected in any burner cycle comprising a flame detecting time period for that particular burner cycle, the control means reducing the length of the warm-up time period in subsequent successive burner cycles in which ignition is successful until the control means detects a certain event in a particular successive burner cycle at which time the control means then increases the length of the previously reduced warm-up time period a certain amount, the certain event being an increase in the length of the flame detecting time period in that particular successive burner cycle over the length of the flame detecting time period on a previous cycle.

Accordingly, it is an object of this invention to provide a new fuel control system having one or more of the novel features of this invention as set forth above or hereinafter shown or described.

Another object of this invention is to provide a new method of making such a fuel control system, the method of this invention having one or more of the novel features of this invention as set forth above or hereinafter shown or described.

Another object of this invention is to provide a new control means for such a fuel control system, the control means of this invention having one or more of the novel features of this invention as set forth above or hereinafter shown or described.

Another object of this invention is to provide a new method of making such a control means, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
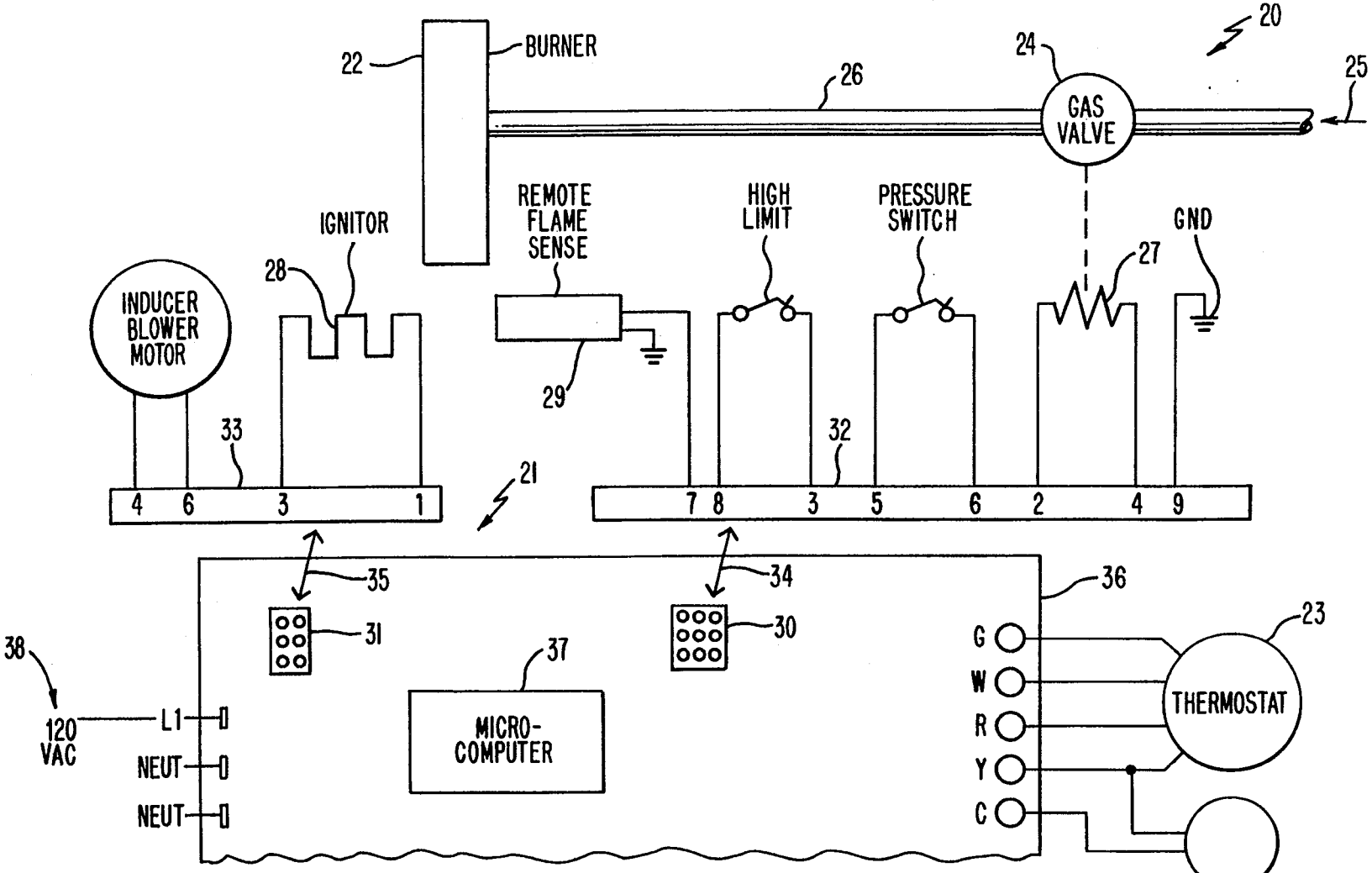
FIG. 1 is a schematic view illustrating the new fuel control system of this invention utilizing the new control means of this invention.

While the various features of this invention are hereinafter illustrated and described as being particularly adapted to provide a fuel control system for a furnace, it is to be understood that the various features of this invention can be utilized singly or in various combinations thereof to provide a fuel control system for other apparatus as desired.

Therefore, this invention is not to be limited to only the embodiment illustrated in the drawings, because the drawings are merely utilized to illustrate one of the wide variety of uses of this invention.

Referring now to FIG. 1, the new fuel control system of this invention is generally indicated by the reference numeral 20 and comprises a control means of this invention that is generally indicated by the reference numeral 21 for controlling a burner means 22 of a furnace (not shown) to tend to maintain an output temperature effect of the burner means 22 at a temperature that had been selected for a thermostat 23 in a manner well known in the art, the burner means 22 and thermostat 23 also comprising part of the fuel control system 20.

In addition, the fuel control system comprises a gas valve means 24 for supplying fuel from a fuel source 25 through a conduit means 26 to the burner means 22 when the control means 21 energizes a coil means 27 of the gas valve means 24 and terminates the flow of fuel to the burner means 22 when the control means 21 deenergizes the coil means 27.

On each burner cycle wherein fuel is directed to the burner means 22 by the gas valve means 24 being energized to an open condition thereof by the control means 21, an electrical resistance igniter means 28 of the system 20 has been previously energized by the control means 21 in a manner hereinafter set forth so as to ignite the fuel issuing from the burner means 22 and a flame detecting means or probe 29 of the system 20, through well known flame rectification, detects when flame appears at the burner means 22 so that the control means 21 will continue to maintain the gas valve means 24 in an open condition to supply fuel to the burner means 22 as long as the thermostat 23 is demanding heat from the burner means 22 for that particular burner cycle, each burner cycle being an operation of the burner means 22 wherein the thermostat 23 determines that the burner means 22 should be in an on condition and ending when the thermostat 23 determines that the burner means 22 should then be turned off as the output temperature effect of the burner means 22 has reached or slightly exceeded the set point setting of the thermostat 23 as is well known in the art.

The control means 21 of this invention as illustrated in FIG. 1 has terminal means 30 and 31 for electrically interconnecting to various parts of the system 20 that are schematically illustrated as being electrically connected to strap members 32 and 33, the members 32 and 33 being electrically interconnected to the terminals 30 and 31 as represented by the respective double-headed lines 34 and 35 in FIG. 1.

The control means 21 is also schematically illustrated in FIG. 1 as comprising an area 36 that has various electrical circuit means (not shown) therein for interconnecting a microcomputer or microprocessor 37 of the control means 21 not only to the terminals 30 and 31 but also to the thermostat 23 and to an electrical power source that is generally indicated by the reference numeral 38 and comprising, in the embodiment illustrated in the drawings, an 120 volt alternating current source that is not only utilized by the control means 21 to energize the igniter means 28 but also to supply electrical current either directly or through a transformer to other parts of the control system 20 in a manner well known in the art. For example, not only see the aforementioned U.S. Pat. 4,925,386, to Donnelly et al, No. but also see the U.S. Pat. Nos. 4,836,770; 4,856,983; 4,971,549; 4,976,605 and 5,209,655 to Geary, whereby these six U.S. Pat. Nos. are all being incorporated into this disclosure by this reference thereto.

Therefore, since the details of the electrical components and their arrangement in a fuel control system as well as how a microcomputer is programmed to perform certain functions are features well known in the art as evidenced by such U.S. patents, a further description thereof is deemed unnecessary whereby the details of how the program of the microcomputer 37 of the control means 21 of this invention is set to uniquely operate the control system 20 will now be described.

As is well known in the art, the manufacturer of an igniter means specifies that that particular igniter means is to be energized for a warm-up period of time with a specified voltage range in order to light gas over the aging process of the igniter means.

Thus, the control means 21 of this invention has the microcomputer 37 thereof programmed to initially provide a warm-up time period for the igniter means 28 that is similar to the manufacturer's specified warm-up time period before the microcomputer 37 energizes the coil means 27 to open the gas valve means 24 on the first burner cycle of the control system 20.

In particular, the thermostat 23 when initially demanding heat from the burner means 22 (or by a testing operation before installation of the control system 20) causes the microcomputer 37 to interconnect the power source 38 to the igniter means 28 for that initial warm-up time period and at the lapse or end of that warm-up time period, the microcomputer 37 energizes the coil means 27 of the gas valve means 24 to cause the gas valve means 24 to now direct fuel to the burner means 22 which will be subsequently ignited by the energized igniter 28 sometime during a valve trial time period that has been programmed into the microcomputer 27 and which begins on the lapse of the warm-up time period, the flame detecting means 29 detecting when flame appears at the burner means 22 and indicating such flame presence to the microcomputer 37 whereby the microcomputer 37 continues to energize the coil means 27 of the gas valve means 24 so that fuel will be continuously fed to the burner means 22 for that initial burner cycle and terminates the operation of the igniter means 28 whereby the burner means 22 continues to issue fuel for its heating purpose as long as the thermostat 23 is demanding a heating output from the burner means 22 on that initial burner cycle. Of course, when the thermostat 23 determines that the heating output effect of the burner means 22 has reached or slightly exceeded the set point temperature thereof, the mircocomputer 37 closes the gas valve means 24 to terminate that initial burner cycle.

However, should the igniter means 28 not ignite the fuel issuing from the burner means 22 during such valve trial time period, the microcomputer 37 after the lapse of such valve trial time period will deenergize the coil means 27 of the gas valve means 24 so as to terminate the flow of fuel to the burner means 22 and either provides a lockout of the control system 20 wherein no further attempts to ignite fuel from the burner means 22 will be provided by the control means 21 until a manual resetting operation takes place or provides one or more additional ignition attempts before such lockout occurs. Such programming and operation of the control system 20 is well known in the art and is provided by the aforementioned U.S. Pat. Nos. that have been incorporated into this disclosure.

However, the microcomputer 37 of this invention has been further uniquely programmed so that if the initial ignition attempt of the burner means 22 on the initial burner cycle of the control system 20 is successful sometime during the initial valve trial time period, the microcomputer 37 will have determined the time period it took the flame detecting means 29 from the beginning or the start of the valve trial time period to when flame was first detected in that burner cycle and such time period in any burner cycle of the system 20 comprises a flame detecting time period for that particular burner cycle.

As previously stated, the microcomputer 37 has been so uniquely programmed that the control means 21 will reduce the length of the warm-up time period in subsequent successive burner cycles in which ignition is successful until the control means 21 detects a certain event in a particular successive burner cycle at which time the control means 21 then increases the length of the previously reduced warm-up time period a certain amount, the certain event being a detection of an increase in the length of the flame detecting time period in that particular successive burner cycle over the length of the flame detecting period on a previous burner cycle.

For example, the initial warm-up time period could comprise 36 seconds (or 17 seconds) as specified by the igniter manufacturer and the control means 21 could reduce that specified warm-up time period a certain amount in each subsequent successive burner cycle, such as reducing it by one second in each subsequent successive burner cycle and then when the control means 21 detects an increase in the length of the flame detecting time period in a particular successive burner cycle over the length of the flame detecting time period on a previous burner cycle, the control means will increase the length of the previously reduced warm-up time period a certain amount, such as one second.

Thereafter, the control means 21 will provide that increased warm-up time period on each subsequent successive burner cycle until the control means detects a second certain event at which time the control means 21 again changes the length of the warm-up time period.

While the second certain event can comprise any desired event, in one working embodiment of the control system 20 of this invention, the second event comprises either the lapsing of a predetermined number of burner cycles or when the control means 21 detects another increase in the length of the flame detecting time period in that particular successive burner cycle over the length of the flame detecting time period on a previous burner cycle whereby the microcomputer means 37 changes the length of the warm-up time period by increasing the length of the previously increased warm-up time period a certain amount, such as by an additional one second or the like.

If the second certain event comprises the lapsing of a predetermined number of burner cycles, such as 250 heating or burner cycles, the control means 21 can begin again reducing the length of the warm-up time period a certain amount on each subsequent successive burner cycle until the control means detects an increase in the length of the flame detecting time period in that particular successive burner cycle over the length of the flame detecting time period on a previous burner cycle at which time the control means then increases the length of the previously reduced warm-up time period a certain amount, such as one second or the like.

Thus, it can be seen that the control means 21 recalculates the minimual warm-up time every 250 heating cycles and if at any time another delayed ignition is noted, the following ignition attempts are lengthened. Therefore, the microcomputer 37 of this invention is programmed to provide the minimal temperature of the igniter means 28 for successful igniting purposes thereof and still light gas reliably on the first ignition attempt for every heating or burner cycle in order to tend to extend the life of the igniter means 28.

Therefore, it can be seen that this invention not only provides a new fuel control system and a new control means therefor, but also this invention provides a new method of making such a control system and a new method of making such a new control means.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a fuel control system comprising a burner means, valve means for controlling the flow of fuel to said burner means, an electrical resistance igniter means for being connected across a power source for igniting fuel at said burner means, flame detecting means for detecting flame at said burner means, and control means operatively interconnected to all of the other said means for connecting said igniter means across said power source for a warm-up time period at the start of each burner cycle and then operating said valve means to supply fuel to said burner means for a valve trial time period that begins upon the lapse of said warm-up time period, said flame detecting means causing said control means to tend to continue to operate said valve means to supply said fuel to said burner means during that particular burner cycle if said flame detecting means detects flame at said burner means before the lapsing of said valve trial time period, the time period it takes to detect flame by said flame detecting means beginning from the start of said valve trial time period to when flame is detected in any burner cycle comprising a flame detecting time period for that particular burner cycle, said control means reducing the length of said warm-up time period in subsequent successive burner cycles in which ignition is successful until said control means detects a certain event in a particular successive burner cycle at which time said control means then increases the length of the previously reduced warm-up time period a certain amount, the improvement wherein said certain event is an increase in the length of said flame detecting time period in that particular successive burner cycle over the length of said flame detecting time period on a previous burner cycle.

2. A fuel control system as set forth in claim 1 wherein said control means then continues to provide said increased warm-up time period on each successive burner cycle until said control means detects a second certain event at which time said control means changes the length of said warm-up time period.

3. A fuel control system as set forth in claim 2 wherein said second certain event comprises another increase in the length of said flame detecting time period in that particular successive burner cycle over the length of said flame detecting time period on a previous burner cycle and wherein the change in the length of said warm-up time period by said control means comprises another increase in the length of said previously increased warm-up time period.

4. A fuel control system as set forth in claim 2 wherein said second certain event comprises the lapsing of a predetermined number of burner cycles from said particular successive burner cycle and wherein the change in the length of said warm-up time period by said control means comprises another reduction in the length of said warm-up time period.

5. A fuel control system as set forth in claim 1 wherein said control means comprises a microcomputer.

6. In a control means for a fuel control system comprising a burner means, valve means for controlling the flow of fuel to said burner-means, an electrical resistance igniter means for being connected across a power source for igniting fuel at said burner means, flame detecting means for detecting flame at said burner means, and said control means being operatively interconnected to all of the other of said means for connecting said igniter means across said power source for a warm-up time period at the start of each burner cycle and then operating said valve means to supply fuel to said burner means for a valve trial time period that begins upon the lapse of said warm-up time period, said flame detecting means causing said control means to tend to continue to operate said valve means to supply said fuel to said burner means during that particular burner cycle if said flame detecting means detects flame at said burner means before the lapsing of said valve trial time period, the time period it takes to detect flame by said flame detecting means beginning from the start of said valve trial time period to when flame is detected in any burner cycle comprising a flame detecting time period for that particular burner cycle, said control means being adapted to reduce the length of said warm-up time period in subsequent successive burner cycles in which ignition is successful until said control means detects a certain event in a particular successive burner cycle at which time said control means is then adapted to increase the length of the previously reduced warm-up time period a certain amount, the improvement wherein said certain event is an increase in the length of said flame detecting time period in that particular successive burner cycle over the length of said flame detecting time period on a previous burner cycle.

7. A control means as set forth in claim 6 wherein said control means then is adapted to continue to provide said increased warm-up time period on each successive burner cycle until said control means detects a second certain event at which time said control means is adapted to change the length of said warm-up time period.

8. A control means as set forth in claim 7 wherein said second certain event comprises another increase in the length of said flame detecting time period in that particular successive burner cycle over the length of said flame detecting time period on a previous burner cycle and wherein the change in the length of said warm-up time period by said control means comprises another increase in the length of said previously increased warm-up time period.

9. A control means as set forth in claim 7 wherein said second certain event comprises the lapsing of a predetermined number of burner cycles from said particular successive burner cycle and wherein the change in the length of said warm-up time period by said control means comprises another reduction in the length of said warm-up time period.

10. A control means as set forth in claim 6 wherein said control means comprises a microcomputer.

11. In a method of making a fuel control system comprising a burner means, valve means for controlling the flow of fuel to said burner means, an electrical resistance igniter means for being connected across a power source for igniting fuel at said burner means, flame detecting means for detecting flame at said burner means, and control means operatively interconnected to all of the other said means for connecting said igniter means across said power source for a warm-up time period at the start of each burner cycle and then operating said valve means to supply fuel to said burner means for a valve trial time period that begins upon the lapse of said warm-up time period, said flame detecting means causing said control means to tend to continue to operate said valve means to supply said fuel to said burner means during that particular burner cycle if said flame detecting means detects flame at said burner means before the lapsing of said valve trial time period, the time period it takes to detect flame by said flame detecting means beginning from the start of said valve trial time period to when flame is detected in any burner cycle comprising a flame detecting time period for that particular burner cycle, said control means reducing the length of said warm-up time period in subsequent successive burner cycles in which ignition is successful until said control means detects a certain event in a particular successive burner cycle at which time said control means then increases the length of the previously reduced warm-up time period a certain amount, the improvement comprising the step of forming said control means so that said certain event is an increase in the length of said flame detecting time period in that particular successive burner cycle over the length of said flame detecting time period on a previous burner cycle.

12. A method as set forth in claim 11 and comprising the step of forming said control means to then continue to provide said increased warm-up time period on each successive burner cycle until said control means detects a second certain event at which time said control means changes the length of said warm-up time period.

13. A method as set forth in claim 12 wherein said second certain event comprises another increase in the length of said flame detecting time period in that particular successive burner cycle over the length of said flame detecting time period on a previous burner cycle and wherein the change in the length of said warm-up time period by said control means comprises another increase in the length of said previously increased warm-up time period.

14. A method as set forth in claim 12 wherein said second certain event comprises the lapsing of a predetermined number of burner cycles from said particular successive burner cycle and wherein the change in the length of said warm-up time period by said control means comprises another reduction in the length of said warm-up time period.

15. A method as set forth in claim 11 and comprising the step of forming said control means to comprise a microcomputer.

16. In a method of making a control means for a fuel control system comprising a burner means, valve means for controlling the flow of fuel to said burner means, an electrical resistance igniter means for being connected across a power source for igniting fuel at said burner means, flame detecting means for detecting flame at said burner means, and said control means being operatively interconnected to all of the other said means for connecting said igniter means across said power source for a warm-up time period at the start of each burner cycle and then operating said valve means to supply fuel to said burner means for a valve trial time period that begins upon the lapse of said warm-up time period, said flame detecting means causing said control means to tend to continue to operate said valve means to supply said fuel to said burner means during that particular burner cycle if said flame detecting means detects flame at said burner means before the lapsing of said valve trial time period, the time period it takes to detect flame by said flame detecting means beginning from the start of said valve trial time period to when flame is detected in any burner cycle comprising a flame detecting time period for that particular burner cycle, said control means being adapted to reduce the length of said warm-up time period in subsequent successive burner cycles in which ignition is successful until said control means detects a certain event in a particular successive burner cycle at which time said control means is then adapted to increase the length of the previously reduced warm-up time period a certain amount, the improvement comprising the step of forming said control means so that said certain event is an increase in the length of said flame detecting time period in that particular successive burner cycle over the length of said flame detecting time period on a previous burner cycle.

17. A method as set forth in claim 16 and comprising the step of forming said control means to then be adapted to continue to provide said increased warm-up time period on each successive burner cycle until said control means detects a second certain event at which time said control means changes the length of said warm-up time period.

18. A method as set forth in claim 17 wherein said second certain event comprises another increase in the length of said flame detecting time period in that particular successive burner cycle over the length of said flame detecting time period on a previous burner cycle and wherein the change in the length of said warm-up time period by said control means comprises another increase in the length of said previously increased warm-up time period.

19. A method as set forth in claim 17 wherein said second certain event comprises the lapsing of a predetermined number of burner cycles from said particular successive burner cycle and wherein the change in the length of said warm-up time period by said control means comprises another reduction in the length of said warm-up time period.

20. A method as set forth in claim 16 and comprising the step of forming said control means to comprise a microcomputer.

* * * * *